United States Patent [19]

Marks et al.

[11] Patent Number: 4,740,176

[45] Date of Patent: Apr. 26, 1988

[54] LATCH AND RETAINER MECHANISM FOR ELECTRICAL CONNECTOR

[75] Inventors: Michael R. Marks, Trumbull; Alfred L. Ehrenfels, Cheshire, both of Conn.

[73] Assignee: Hubbell Incorporated, Orange, Conn.

[21] Appl. No.: 29,945

[22] Filed: Mar. 25, 1987

[51] Int. Cl.[4] ..... H01R 13/40

[52] U.S. Cl. ..... 439/589; 439/588

[58] Field of Search ..... 439/271, 278, 282, 299, 439/338, 339, 345, 349, 352, 368, 372, 488, 489, 587, 588, 589, 592, 595, 603, 641, 638, 659, 600, 744, 747, 748

[56] References Cited

U.S. PATENT DOCUMENTS

| | | | |
|---|---|---|---|
| 2,563,712 | 8/1951 | Frei et al. | 439/600 |
| 2,655,638 | 10/1953 | Allen | 439/589 |
| 2,740,098 | 3/1956 | Phillips | 439/589 |
| 2,892,173 | 6/1959 | Brereton | 439/589 |
| 3,477,061 | 11/1969 | Stephenson | 439/589 |
| 3,708,780 | 1/1973 | Pierce | 439/589 |
| 4,053,201 | 10/1977 | Grappe | 439/589 |
| 4,583,804 | 4/1986 | Thompson | 439/588 |

*Primary Examiner*—Gil Weidenfeld

*Assistant Examiner*—Paula A. Austin

*Attorney, Agent, or Firm*—Jerry M. Presson; Walter C. Farley

[57] ABSTRACT

An electrical connector has male and female housing halves each of which has front and rear housing portions. The rear housing portion has an externally threaded front end, a stop shoulder at the rear extent of the threads and a hole to receive a latch pin. The front housing portion has internal threads at the rear end to engage the threads on the rear housing portion and also has an end face with a recess. The latch pin penetrates the rear housing near the stop shoulder and has a non-symmetrical head. The latch pin can be rotated between a position in which the head protrudes beyond the stop shoulder and a position in which it does not protrude beyond the stop shoulder. When fully threaded together, the recess is aligned with the latch pin which can be rotated to its latching, protruding position to prevent unthreading of the housing portions. The rear housing portion also contains a slidable cup which is elastomerically urged toward the front housing portion when the portions are assembled to maintain internal components in their proper position.

11 Claims, 5 Drawing Sheets

LATCH AND RETAINER MECHANISM FOR ELECTRICAL CONNECTOR

CROSS REFERENCE TO RELATED APPLICATION

This invention is related to an apparatus disclosed in our copending commonly assigned application entitled Electrical Connector With Component Keying System, Ser. No. 030,055, filed concurrently herewith, the content of which is hereby incorporated by reference.

This invention relates to electrical connectors and particularly to a latching system and a retainer system for interlocking portions of a connector housing and for solidly holding components within the housing.

BACKGROUND OF THE INVENTION

Power connectors made for high current usage are generally formed with two connector halves, each half being provided with housings having a cable clamp at one end and the electrical connection means, either male blades or female contacts, at the other. Various techniques are used to assemble the housings for these connectors and to retain the internal components in their proper positions, and the housings are made in a variety of different shapes and sizes. Generally, some kind of fastener is used which requires tools, sometimes special tools, to take the connector apart.

Whatever device is used should hold the components together firmly and resist inadvertent disassembly. However, it is desirable to be able to disassemble the connector housing in a relatively simple and quick manner so that the internal portions can be serviced whenever necessary.

BRIEF SUMMARY OF THE INVENTION

Accordingly, an object of the present invention is to provide a connector having means in the connector housing for holding the components together firmly and for sealing the interior of the housing against moisture and dirt.

A further object is to provide housing portions which are threaded together with a latch to keep the housing portions in fully threaded engagement when in the locked position but to be easily releasable with a simple tool.

A still further object is to provide a connector housing which can be opened by separating housing portions to permit easy access to the internal wiring without there being any loose components and which can be easily reclosed so that the connector housing is safely and securely assembled.

Yet another object is to provide such a connector with a latch which is molded plastic and which is simple and inexpensive to produce and easy to install yet durable and secure.

Briefly described, the invention includes an electrical connector of the type having a male half and a female half which are joinable, the male half having a plurality of axially protruding blades and the female half having a plurality of openings with contact means positioned to receive the blades. Each half comprises front and rear housing portions, the rear portion having a cable clamp at the rear end, an externally threaded portion at the front end, a stop shoulder adjacent the rear end of the threaded portion and a radial hole through the rear housing portion. The front portion has an internally threaded portion and threadedly engageable with the externally threaded portion at the rear end of the front portion, an end face at the rear end thereof to contact the stop shoulder and a recess in the end face. Latch means is carried by the rear portion, the latch means including a latch pin extending through the radial hole in the rear housing portion, the latch pin being rotatable between a latching position in which part of the latch pin protrudes forwardly beyond the stop shoulder and an unlatched position in which the latch pin is retracted behind the stop shoulder. The threaded portions on the housing portions are arranged so that when the housing portions are fully threaded together the end face is closely adjacent the stop shoulder and the recess in the end face is aligned with the latch pin so that the pin can be rotated to the latching position in which the protruding part of the pin enters the recess and prevents the housing portions from being unthreaded.

In another aspect, the invention includes a connector as described above and further including a cup slidably received in the rear housing portion, the cup having an open end facing in the same direction as the open end of the rear housing portion. The cup has an elongated opening in the side dimensioned to receive the inner end of the latch pin in a sliding relationship such that the cup is capable of limited axial movement within the housing and so that the cup can also function as part of the detent for the latch.

BRIEF DESCRIPTION OF THE DRAWINGS

In order to impart full understanding of the manner in which these and other objectives are attained in accordance with the invention, a particularly advantageous embodiment thereof will be described with reference to the accompanying drawings, which form a part of this specification, and wherein.

DESCRIPTION OF THE PREFERRED EMBODIMENT

Figure 1:
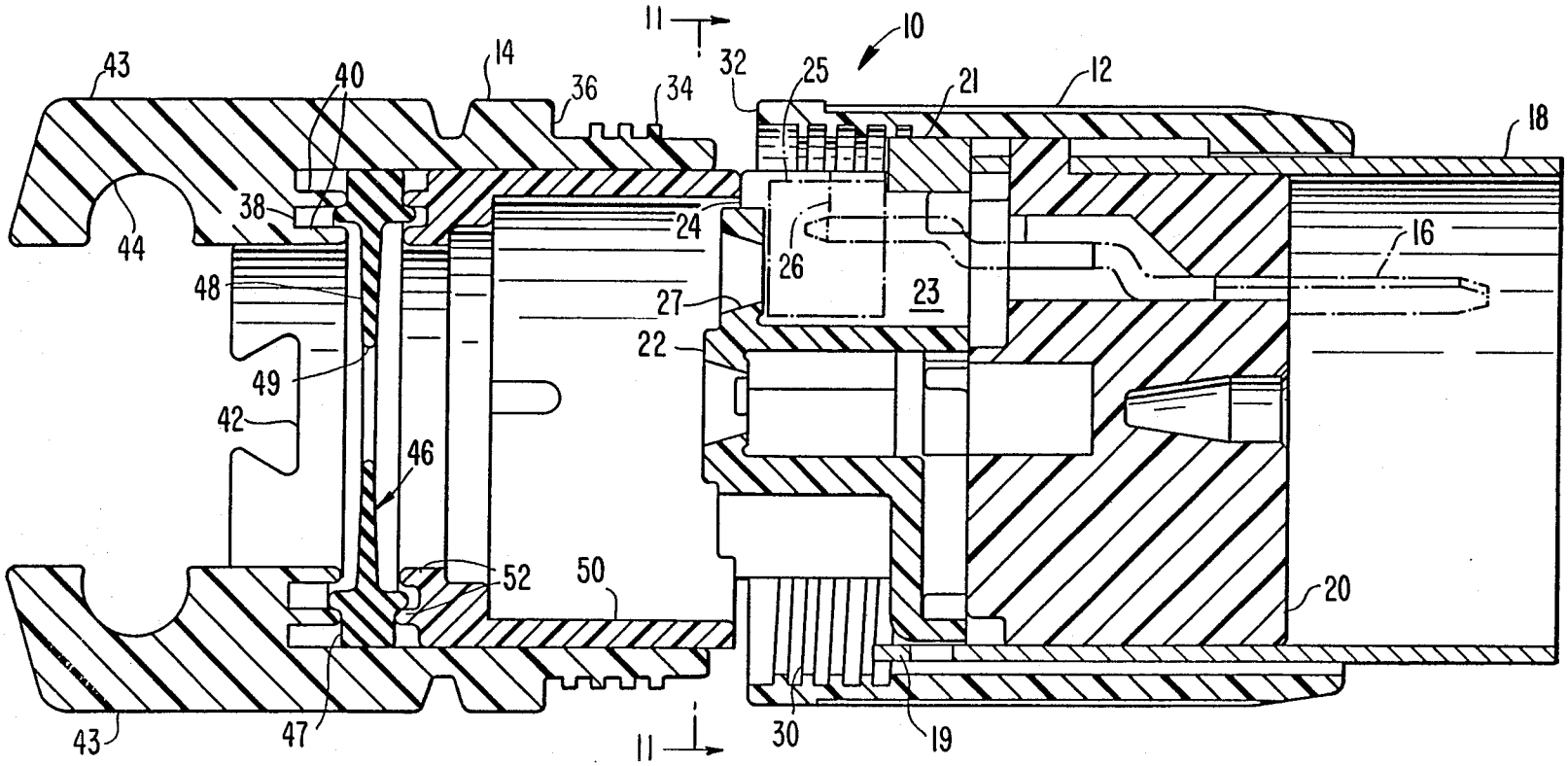
FIG. 1 is a side elevation, in longitudinal section, of an electrical connector incorporating the apparatus of the present invention.

FIG. 1 shows a side elevation, in longitudinal section, of a connector half indicated generally at 10 of the type to which the invention relates. As shown in FIG. 1, the connector half is partly disassembled and it can be seen that the housing includes a front housing portion 12 and a rear housing portion 14 which are adapted to be joined together. The connector half illustrated in FIG. 1 is a male connector having blades 16, one of which is shown in phantom lines. However, the principles of the invention are equally applicable to a female connector.

Front housing 12 partly surrounds a sleeve 18 which, in this particular connector, is metal and surrounds the protruding ends of blades 16 which will be received in the contact elements of the female connector half when the two are joined together. The connector halves include coupling structures to lock them together when they are joined, but this structure is not part of the present invention and will not be further described herein.

Front housing 12 and sleeve 18 contain a blade holder 20 which is a body of insulating material having cavities to receive the blades 16 and hold them in the proper position so that one end protrudes in a direction to be received by the female connector half and the other end extends rearwardly. The rearwardly extending end of each blade is received in a cavity of a contact holder body 22 which also comprises a body of insulating material. The cavities such as cavity 23 in body 22 are shaped and dimensioned to receive a box contact 25 having a set screw 26, the box contact surrounding the rear protruding end of the blade. An opening 27 in the back end of body 22 is provided to permit the insertion of a wire into contact 25 within cavity 23. Thus, when the set screw 26 is tightened, the rear end of the blade and the inwardly extending end of a stripped wire are clamped within the box contact and are thereby electrically and mechanically held together.

Front housing portion 12 has an internally threaded portion at the rear end thereof with threads 30. The rear end of housing portion 12 terminates at an end face 32.

Figure 11:
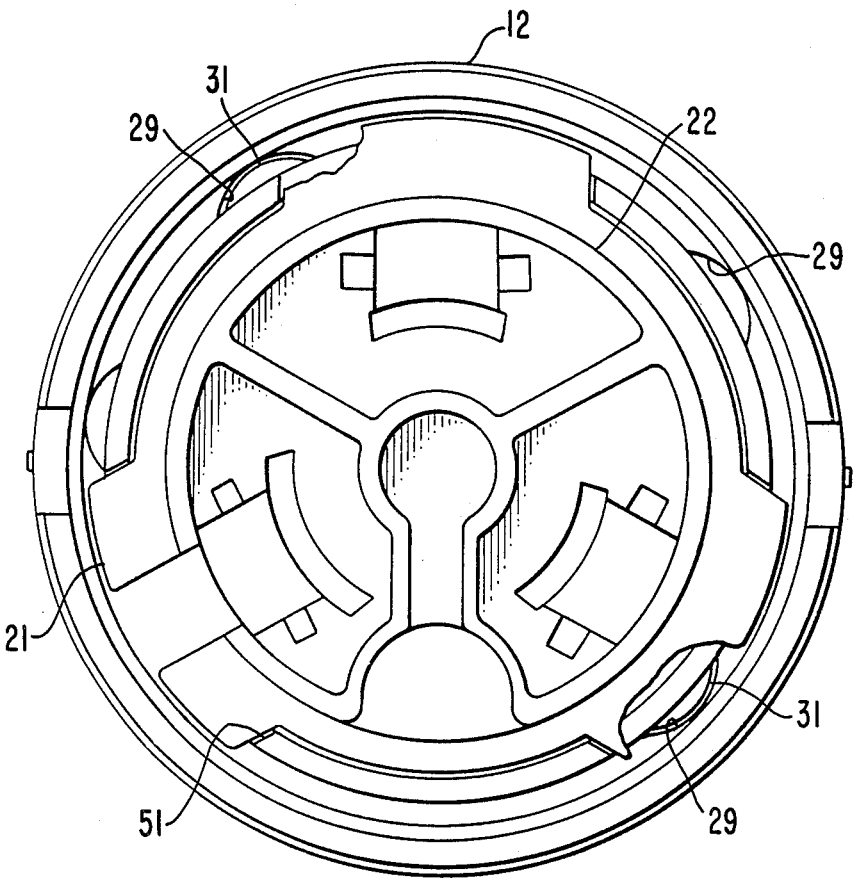
FIG. 11 is an end view of the front portion of the connector along line 11—11 of FIG. 1.

It should also be mentioned that sleeve 18 has rearwardly protruding axial tabs 19 which can be bent inwardly to prevent the blade and contact holding bodies 20, 22 from escaping from the interior of the sleeve. However, there is normally some clearance so that the bodies are not tightly retained within the sleeve. It should also be mentioned that front housing 12 can be provided with axial grooves at selected circular positions which match radial protrusions on the outer portions of sleeve 18 so that the sleeve and front housing are keyed together to be sure that the housing is in a particular circular orientation with respect to not only the sleeve but also the components received therein. This is illustrated in FIG. 11 and in copending application Ser. No. 030,055.

Rear housing 14 is provided with an externally threaded portion with threads 34 which are formed and dimensioned to threadedly engage threads 30. At the rear limit of the threaded portion is a forwardly facing stop shoulder 36 which abuts end face 32 when the two housing portions are threaded together.

Housing portion 14 is cylindrical and substantially hollow and is formed with a forwardly facing internal shoulder 38 having annular ribs 40 protruding forwardly therefrom. At the rear end of housing portion 14 are guide grooves 42 for receiving the halves of a cable clamp. Cable clamp supports 43 protrude rearwardly on opposite sides of housing 14 to position the cable clamp structure, supports 43 having semicircular recesses 44 through which the cable clamp fasteners can pass. The clamp structure itself is conventional.

Within housing portion 14 is a generally disk-shaped elastomeric seal member 46, the seal member having a thick annular portion 47 and a radially inwardly protruding web 48 having a central opening 49. Opening 49 is dimensioned to receive a cable entering housing portion 14 from the rear end thereof, the web portion of seal 48 being elastically deformable so as to tightly surround the cable and limit entry of moisture and dirt. When a cable is inserted through the web opening and then partially withdrawn, part of the web lies along the outer surface of the outer insulation cover of the cable. The opening and the radial width of the web are such that a good seal is thus formed with cables having a wide range of diameters.

Also within housing 14 is a sliding cup 50 which is provided at its rear end with annular ribs 52. In the position shown in FIG. 1, cup 50 protrudes forwardly from the forward open end of housing 14. However, when housing portions 12 and 14 are assembled together with threads 30 and 34 fully engaged, a plurality of shoulders 24 on the contact holder 22 abut the forward end face of cup 50 and press it rearwardly into housing portion 14. This causes annular ribs 52 on the cup and 40 on housing portion 14 to press against the thickened portion 47 of seal 46, tightly engaging it between those components and retaining it in position. The inner ribs prevent the thickened annular portion from moving radially inwardly as there would be a tendency to do when a cable passing through opening 49 is moved. The compression of seal portion 47 elastically urges cup 50 toward contact holder 22 so that the contact holder is pressed into position in sleeve 18 wherein radially protruding lugs such as lug 21 are firmly seated in notches in the sleeve. This elastic force acts as a compensation for variations in the tolerances of the components such as molded bodies 20 and 22 and also for size changes which result from seasoning of those parts and also changes resulting from thermal expansion. In addition, this forward pressure elastically resists axial forces transferred from the blades when the connector halves are joined.

Figure 2:
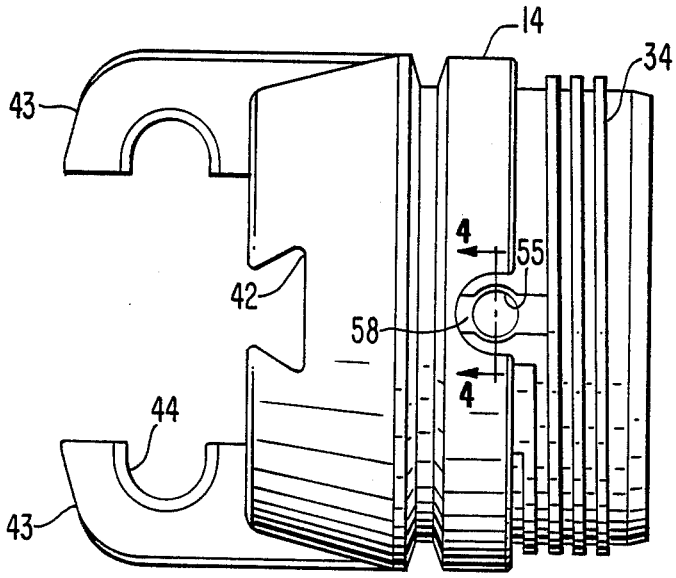
FIG. 2 is a side elevation of the rear housing portion of the connector of FIG. 1.
Figure 4:
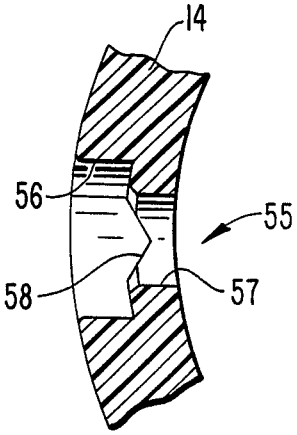
FIG. 4 is an enlarged partial sectional view along line 4—4 of FIG. 2.

FIG. 2 is a view of rear housing portion 14 in the same direction as in FIG. 1 but without the front housing portion and not in section. Of particular significance in FIG. 2 is the provision of a radial hole 55 which passes through the rear housing, the hole being positioned with its central axis on a line near stop shoulder 36. Hole 55 is shown in greater detail in the partial sectional view of FIG. 4. As seen in FIG. 4, hole 55 has a large diameter portion 56 and a smaller diameter portion 57, the shoulder between those portions having V-shaped indentations 58 on opposite sides of the hole.

Figure 3:
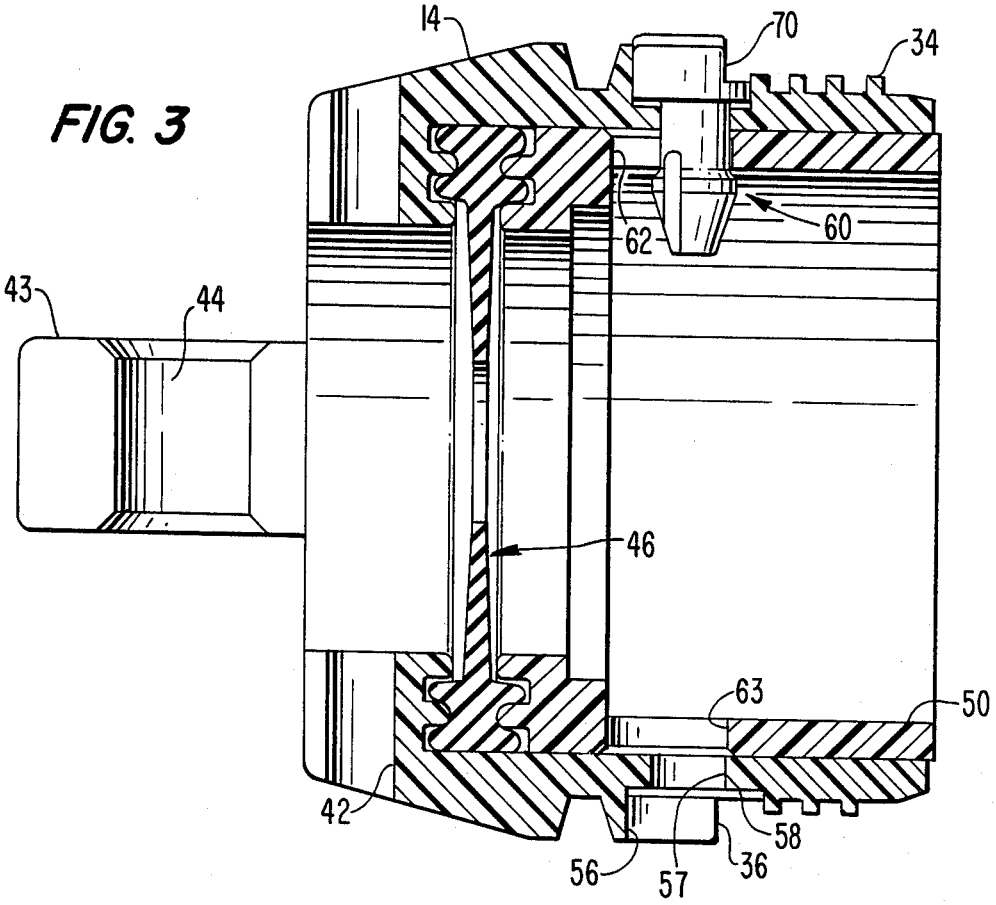
FIG. 3 is a top plan view, in longitudinal section, of the rear housing of FIG. 3 and components housed therein.
Figure 5:
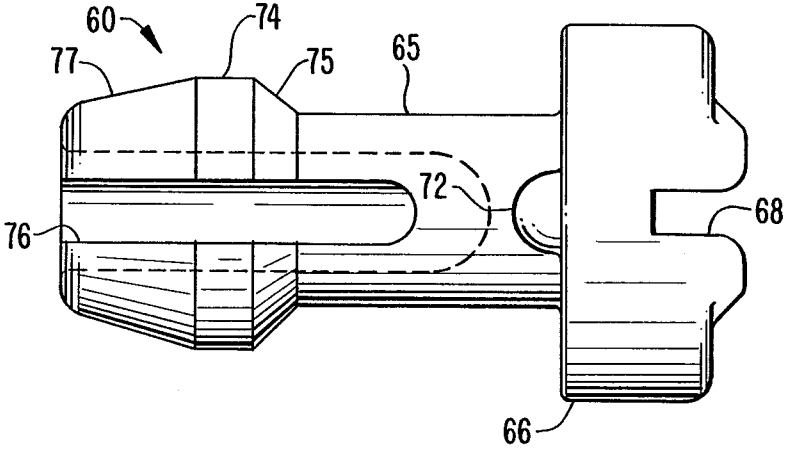
FIG. 5 is a side elevation of a latch pin usable in the housing structure of FIGS. 1–4.

The purpose of the hole is to receive a latch pin 60 which is shown in position in FIG. 3. FIG. 3 is a sectional view of the rear housing in a direction 90° away from FIGS. 1 and 2. It will be observed that the top and bottom portions of the rear housing each have a hole 55 with a larger diameter portion 56, a smaller diameter portion 57 and detent notches 58. The latch pin is omitted from the lower opening so that the details thereof can be seen. It will also be observed that cup 50 is provided with diametrically opposite openings 62 and 63, these openings being alignable with holes 55, the openings 63 being elongated in the axial direction. Thus, when latch pin 60 is in the assembled position as shown in the upper portion of FIG. 3, cup 50 is free to move axially to a limited extent as described in connection with FIG. 1.

Figure 8:
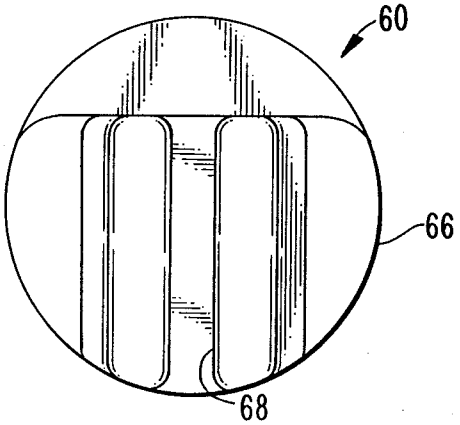
FIGS. 7 and 8 are top plan and right-end elevations, respectively, of the latch pin of FIGS. 5 and 6.
Figure 6:
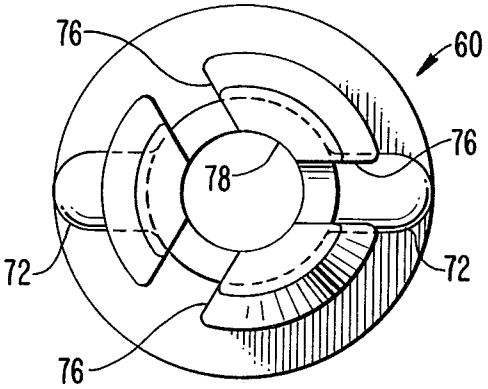
FIG. 6 is a left-end elevation of the latch pin of FIG. 5.
Figure 7:
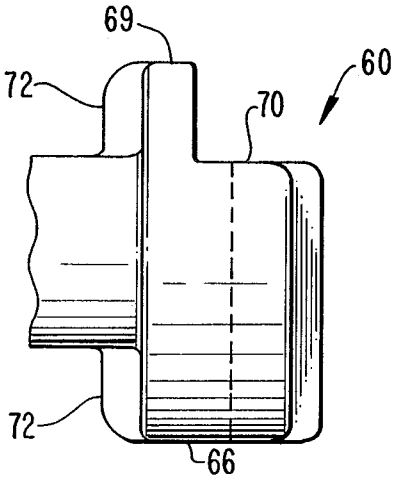

The latch pin 60 is shown in somewhat more detail in FIGS. 5–8 in which it will be seen that the latch pin includes a central, cylindrical body portion 65 which has a diameter substantially equal to portion 57 of hole 55. At the outer end of the latch pin is an enlarged head 66 substantially equal in diameter to portion 56 of hole 55 and having a transverse slot 68 dimensioned to receive a screw driver or a small coin to rotate the latch pin about its central axis. As best seen in FIGS. 7 and 8, the head is symmetrical about an axial plane passing along the center of slot 68 but is not symmetrical about an axial plane passing transversely across the slot. The head has a lower portion 69 which is circular to provide a smooth and continuous rotational guide surface, thereby defining a fixed axis of rotation, but the upper portion of the head is D-shaped, having a semicircular or chordal segment omitted therefrom to leave a substantially flat face 70. This flat face 70 permits rotation of the adjacent part in the unlatched position. The central axis of hole 55, and therefore also the central axis of pin 60, is spaced from the plane containing stop shoulder 36 by the same distance as that between the central axis of pin 60 and face 70 so that when the pin is rotated to the position shown in the top of FIG. 3, face 70 does not protrude forwardly beyond shoulder 36.

Radially extending ribs 72 are formed on the underside of head 66 in alignment with slot 68 to form a detent arrangement with grooves 58 in hole 55.

The inner end of pin 60 is provided with an enlargement 74 having an outer diameter somewhat larger than hole 57 and having tapered surfaces 75 and 77 at opposite ends thereof. However, the pin is formed with recesses 76 which extend axially into the body of the pin within and beyond the enlarged portion, these recesses joining a central cavity 78 which extends axially into body 65. Pin 60 is made of a polymeric material such as Zytel which is rather stiff but has some elasticity. Thus, the distal ends of the latch pin can be squeezed together to form an entering portion having a diameter smaller than that of portion 57 of hole 55 for purposes of assembly. Once within the interior of housing portion 14 and cup 50, the expanding enlargement 74 retains the pin in position until a force is intentionally exerted from the inside of the cup to remove it.

While installed, the pin is freely rotatable by a tool inserted in slot 68 and turned but the pin tends to remain in a position with slot 68 aligned with notches 58 into which ribs 72 are positioned. The length of body portion 65 is selected so that inclined surfaces 75 of the pin act against the inner edges of elongated holes 63 in cup 50 to cause a spring force which retains the ribs in grooves 58. When the latch pin is rotated to the position in which ribs 72 are aligned with grooves 58, the spring force supplied by the elasticity of the trifurcated end of the latch pin causes an audible snap which tells the operator that the pin is in the fully latched or unlatched position. It is also visually apparent that the latch pin is in its unlatched position.

Figure 9:
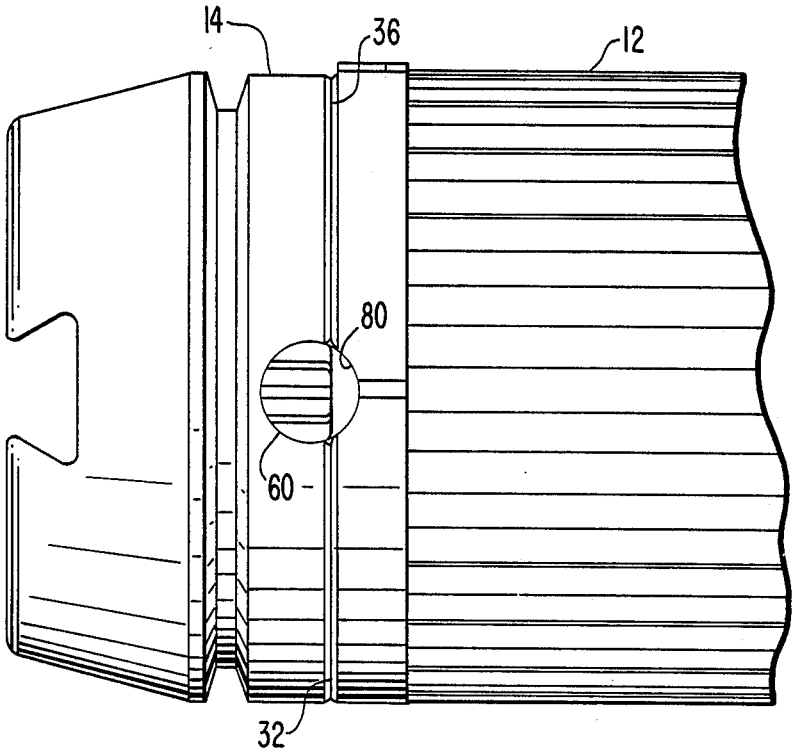
FIGS. 9 and 10 are partial side elevations of the connector of FIG. 1 showing the latch pin in the unlatched and latched positions, respectively.
Figure 10:
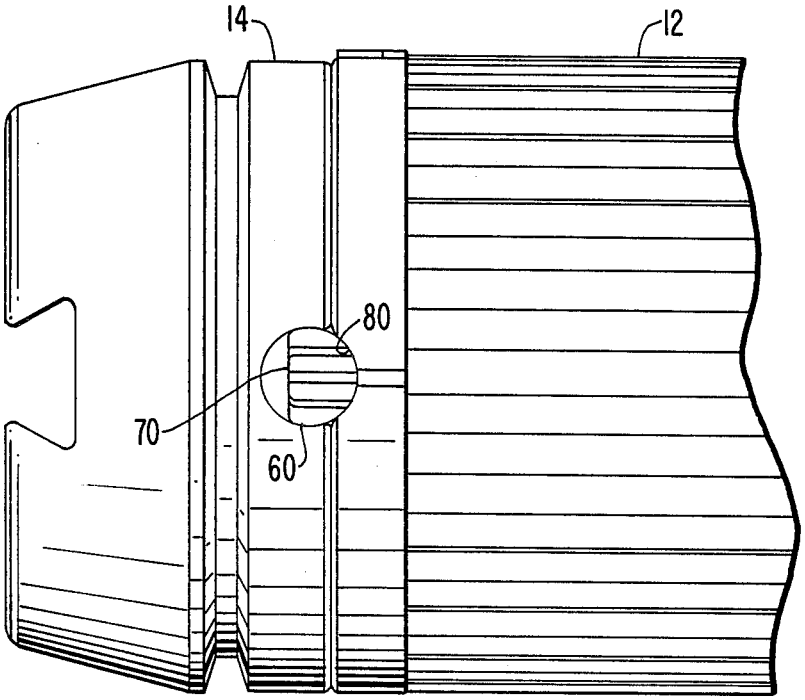

FIG. 9 is a partial top view of housing portions 12 and 14 in their fully assembled positions. As will be seen in FIG. 9, front housing 12 is provided with an arcuate recess 80 extending axially in from end face 32. Recess 80 is positioned in that portion of the end face which is aligned with the center of hole 55 and, therefore, with the central axis of the latching pin 60 when threads 30 and 34 are fully threadedly engaged and with end face 32 closely adjacent stop shoulder 36. When latch pin 60 is in the rotational position shown in FIGS. 3 and 9, surface 70 is aligned with stop shoulder 36, as mentioned, so that housing 12 can be threaded onto housing 14 and can also be unthreaded therefrom.

However, when latch pin 60 is rotated 180° so that the ribs 72 exchange positions in grooves 58, a portion of the latch pin enters recess 80, preventing relative rotation between housings 12 and 14. In this latching position, the two housings are securely locked together. For total security, the latch pins on both sides of the housings should be moved to the latching position, although one latch pin is quite adequate to prevent disassembly of the connector half. The only force necessary to unlock the housings for disassembly is rotation of the two latch pins to the position shown in FIG. 9.

It was previously mentioned that cup 50 is urged toward the rear (cable entry) end of housing portion 14 by contact with shoulders 24 on contact holder 22, and that the cup thereby compresses seal portion 47. This resiliently urges cup 50 forward and provides a further spring action which assists in holding the latch members in place and contributes to the action thereof. The cup also contributes to the abrupt, snap movement of the latch pin which produces the audible indication of its movement to the proper position, latched or unlatched.

While one advantageous embodiment has been chosen to illustrate the invention, it will be understood by those skilled in the art that various changes and modifications can be made therein without departing from the scope of the invention as defined in the appended claims.

What is claimed is:

1. An electrical connector of the type having a male half and a female half which are joinable, the male half having a plurality of axially protruding blades and the female half having a plurality of openings with contact means positioned to receive the blades, the improvement wherein each half comprises front and rear housing portions, said rear housing portion having an externally threaded portion at the front end, a forwardly facing stop shoulder adjacent the rear end of said threaded portion and a radial hole through said rear housing portion, and said front housing portion having an internally threaded portion at the rear end of said front portion threadedly engageable with said externally threaded portion, an end face at the rear end thereof to contact said stop shoulder and a recess in said end face which is aligned with said radial hole when said threaded portions are fully threadedly engaged; and latch means carried by said rear portion including a latch pin extending through said radial hole in said rear housing portion, said latch pin being rotatable between a latching position in which part of said latch pin protrudes forwardly beyond said stop shoulder and an unlatched position in which said latch pin is retracted behind said stop shoulder;

said threaded portions on said housing portions being arranged so that when said housing portions are fully threaded together said end face is closely adjacent said stop shoulder and said recess in said end face is aligned with said latch pin so that said latch pin can be rotated to said latching position in which said protruding part of said pin enters said recess and prevents said housing portions from being unthreaded.

2. A connector according to claim 1 wherein said latch pin comprises an elongated body extending through said opening and rotatable about a line near said stop shoulder, said body having an enlarged head which is non-symmetrical relative to said line, said head being exposed to the outside of said connector.

3. A connector according to claim 2 wherein said latch pin further comprises means defining at least one axial recess for separating the inner end of said pin into separated portions, said inner end being enlarged to a diameter greater than the diameter of said hole, said body being sufficiently resilient so that said at least one axial recess forming said separated portions partially closes to permit said enlarged inner end to pass through said opening for assembly.

4. A connector according to claim 3 and further comprising a second hole through said rear portion diametrically opposite the first said hole and a second latch pin in said second hole, said second latch pin being substantially identical to the first said latch pin, said front housing portion having a second recess to receive said second latch pin in its latching position.

5. A connector according to claim 4 wherein each of said latch pins has a slotted head to receive a tool for rotating said pin.

6. A connector according to claim 1 and further comprising a cup slidably received through an open end in said rear housing portion, said cup having an open end facing in the same direction as the open end of said rear housing portion;

means in a side of said cup defining an opening therethrough, said opening being elongated in the axial direction relative to said rear housing portion and dimensioned to receive an inner end of said latch pin in a sliding relationship such that said cup is capable of limited axial movement within said rear housing portion.

7. A connector according to claim 6 wherein said rear housing portion further includes an annular elastomeric seal having a central opening for passage of an entering electrical cable in a tight engagement with said seal, said rear housing portion having a forwardly facing internal shoulder abutting said seal so that said seal is positioned between said internal shoulder and said cup.

8. A connector according to claim 7 wherein said front housing portion receives insulating bodies carrying conductive parts of said connector, and wherein said cup includes a forwardly facing surface which protrudes beyond the front end of said rear housing in the unassembled condition of said connector, said forwardly facing surface being operative to engage one of said insulating bodies when said housing portions are assembled, said cup being urged forward by said elastomeric seal as said seal is clamped between said internal shoulder and the rearwardly moving cup.

9. A connector according to claim 8 wherein said annular seal is disk-shaped having a thick annular rim and a central web.

10. An electrical connector of the type having a male half and a female half which are joinable, the male half having a plurality of axially protruding blades and the female half having a plurality of openings with contact means positioned to receive the blades, the improvement wherein each half comprises front and rear housing portions, said rear portion having a cable clamp at the rear end, one of said housing portions having an open end, an externally threaded portion adjacent said open end, a stop shoulder adjacent the end of said threaded portion which is located farthest from said open end and a radial hole through said one of said housing portions; and the other of said housing portions having an open end, an internally threaded portion adjacent said open end threadedly engageable with said externally threaded portion on said one housing portion, an end face at said open end thereof positioned to approach said stop shoulder when said threads are fully engaged, and a recess in said end face; and latch means carried by said one housing portion including a latch pin extending through said radial hole in said one housing portion, said latch pin being rotatable between a latching position in which part of said latch pin protrudes beyond said stop shoulder and an unlatched position in which said latch pin is retracted behind said stop shoulder;

said threaded portions on said housing portions being arranged so that when said housing portions are fully threaded together said end face is closely adjacent said stop shoulder and said recess in said end face is aligned with said latch pin so that said latch pin can be rotated to said latching position in which said protruding part of said pin enters said recess and prevents said housing portions from being unthreaded.

11. A connector according to claim 10 wherein said latch means further includes detent means for providing an abrupt axial movement of said latch pin to thereby produce an audible indication of the fully latched or unlatched positions of said pin.

* * * * *